United States Patent [19]

Thom

[11] Patent Number: 4,712,947

[45] Date of Patent: Dec. 15, 1987

[54] MINE SUPPORT PROP

[75] Inventor: Michael J. Thom, Krugersdorp, South Africa

[73] Assignee: Hunt Leuchars and Hepburn Limited, South Africa

[21] Appl. No.: 284,727

[22] Filed: Jul. 20, 1981

[30] Foreign Application Priority Data

Jul. 22, 1980 [ZA] South Africa ..... 80/4405

[51] Int. Cl.[4] ..... E21D 15/02; E04G 25/02

[52] U.S. Cl. ..... 405/288; 248/351

[58] Field of Search ..... 405/288, 290, 211, 216; 52/727, 728; 248/351, 354 R, 356

[56] References Cited

U.S. PATENT DOCUMENTS

| | | | |
|---|---|---|---|
| 1,752,101 | 3/1930 | Meutsch | 405/290 X |
| 4,052,029 | 10/1977 | Townsend | 248/356 |
| 4,306,821 | 12/1981 | Moore | 405/211 X |

FOREIGN PATENT DOCUMENTS

| | | | |
|---|---|---|---|
| 174324 | 6/1904 | Fed. Rep. of Germany . | |
| 173689 | 1/1922 | United Kingdom | 248/351 |
| 851283 | 10/1960 | United Kingdom | 405/288 |

*Primary Examiner*—Nancy J. Stodola

*Attorney, Agent, or Firm*—Pasquale A. Razzano

[57] ABSTRACT

A mine support prop which includes a timber load support member which is elongated in the direction of its grain, and includes a zone of reduced cross-section and a sleeve which is preferably made from mild steel, which surrounds the support member over a substantial portion of its length and extends over the zone of reduced cross-section and onto the timber member on either side of the reduced cross-section zone to support the timber member against bending when it is compressed under load in its axial direction.

4 Claims, 10 Drawing Figures

MINE SUPPORT PROP

FIELD OF THE INVENTION

This invention relates to mine or the like support props which are made from or include timber load resisting elements.

BACKGROUND TO THE INVENTION

Unadorned timber poles have a very limited compression capability in the direction of the timber grain.

In mines in which the hangings close with the footwalls, various expedients have been resorted to prolong the load supporting life of plain wooden props. The most useful methods of stretching the life of a wooden pole is by the use of a cross-grain head boards and tapered ends which only slightly increase the degree by which the props may be decreased in length under compression. A fairly recent innovation which considerably increases the degree of longitudinal compression of a prop is to encase the prop in a sleeve of material such as ductile mild steel which surrounds the prop over a substantial portion of its length and is adapted progressively to release hoop stress built up in the timber element as it is compressed.

A problem with the sleeved props is that although they are quicker to accept load than for example a mat pack their performance characteristics display, after they initially become load supporting, a rapid loss of support before again becoming fully load supporting. There is a possibility that this problem may induce bed separation and open rock joints to destabilize the hanging.

OBJECT OF THE INVENTION

It is the object of this invention to provide a sleeved prop in which the above problem is at least minimised.

SUMMARY OF THE INVENTION

A mine support prop according to the invention includes a timber load support member which is elongated in the direction of its grain and includes a zone of reduced cross-section and a sleeve of suitable material which surrounds the support member in and on either side of its zone of reduced cross-section to support the support member in its axial direction.

In one form of the invention the material of the sleeve is a ductile mild steel adapted yieldably to restrain an increase in the cross-sectional dimension of the support member as the prop is reduced in length under load.

Preferably the zone of reduced cross-section of the support member is provided by a circumferential groove in the support member.

Conveniently the groove lies in a plane which is normal to the prop axis.

The radius ratio of the ground portion of the timber member may be between 0:4 to 0:99 but is preferably about 0:85 (i.e. the cross-sectional area of the timber member is between 40 and 90% but preferably 85% of the cross-sectional area of the non-reduced portion of the timber member). The depth of the groove may be between 5 and 15% of the diameter of the support member. Additionally the groove may extend over a substantial proportion of the length of the support member.

BRIEF DESCRIPTION OF THE DRAWINGS

The invention is now described by way of example only with reference to the drawings in which.

DETAILED DESCRIPTION OF THE INVENTION

Figure 1:
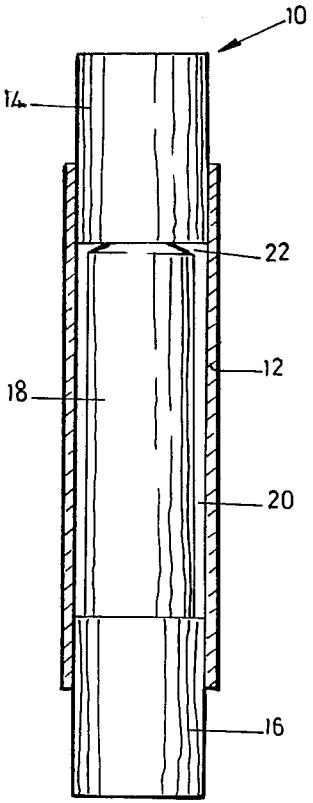
FIG. 1 is a side elevation of the prop of the invention with its sleeve shown in cross-section.

One embodiment of the prop of the invention is shown in FIG. 1 to consist of an elongated timber load support member 10 and a sleeve 12 which surrounds the support member over a substantial portion of its length.

The timber member 10 is made from fairly hard wood such as saligna. The member 10 is circular in cross-section and includes head and foot pieces 14 and 16 which are located in and project from the sleeve 12 and a central zone 18 which is turned down relatively to the head and foot pieces to provide an annular void 20 between the zone 18 and the sleeve 12. The timber element 10 additionally carries a secondary V-shaped groove 22 in the zone 18 immediately below the head piece 14.

The sleeve 12 is made from a mild steel which has sufficient ductility yieldably to restrain expansion of the member 10 in a radial direction when under load.

The sleeve 12 is a friction fit over the timber member 10 and it is important that the sleeve completely surrounds the zone 18 of the member 10 and projects sufficiently above and below it to provide adequate sockets for preventing skewing of the head and foot pieces of the member 10 under load.

Figure 3:
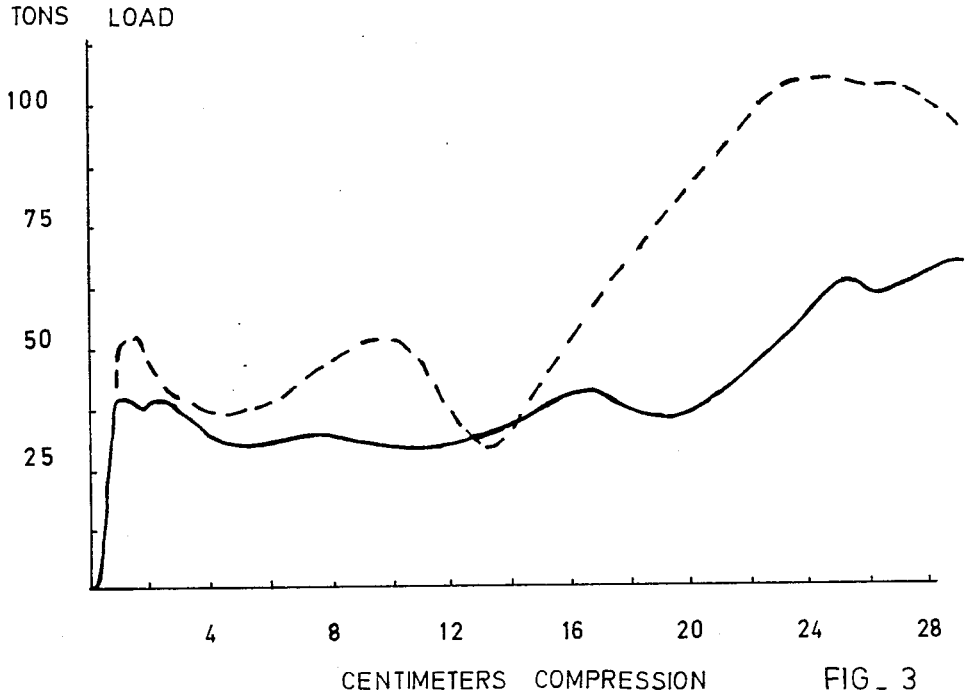
FIG. 3 is comparative performance graphs.

A prop of the FIG. 1 type was compressed in a press in an axial direction to produce the graph A of FIG. 3. The test prop had an initial length of 1,200 mm. The saligna member 10 had a diameter of 165 mm.

The length of the zone 18 was 400 mm with a diameter of 135.5 mm. The sleeve 12 was made from mild steel BS 1775 of 1964 to grade ERW 11, was 900 mm long and had a wall thickness of 2,8 mm. The groove 22 was cut into the zone 18 to a depth of 10 mm and had a width of 20 mm.

Figure 2:
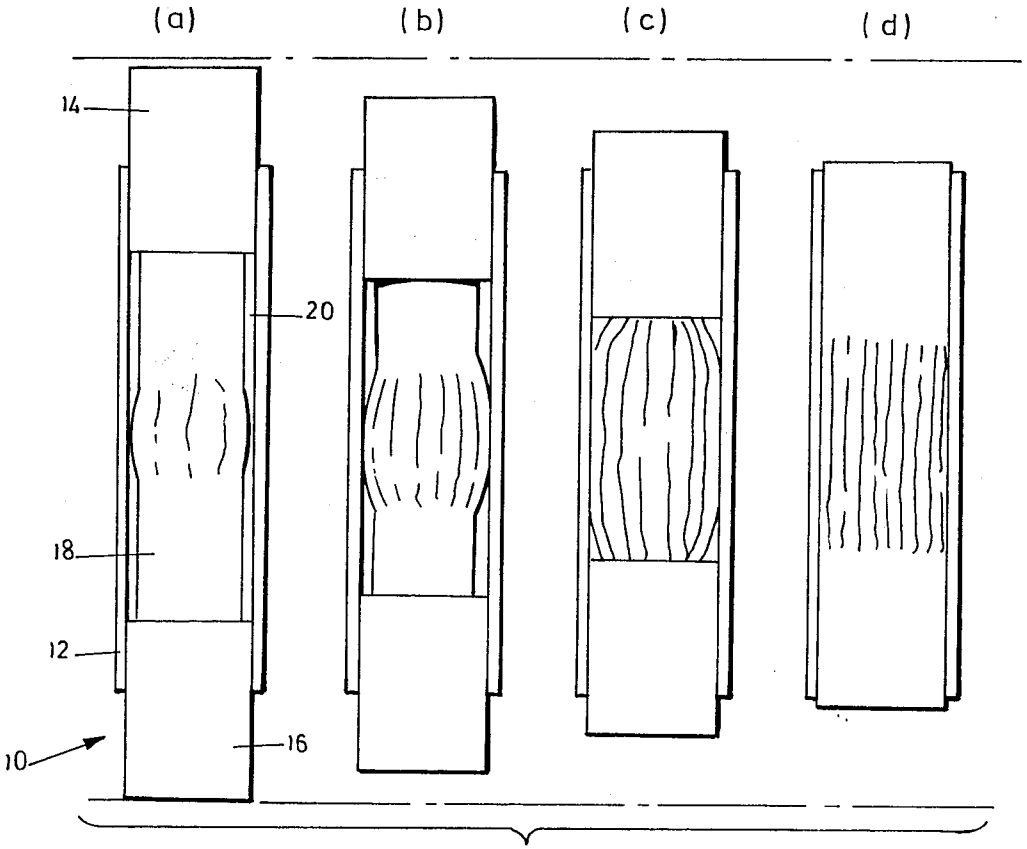
FIGS. 2 (*a*) to (*d*) are schematic illustrations of the behaviour of the prop of FIG. 1 while being compressed in length under load in an axial direction.

As is seen in FIG. 3 the prop of the invention accepted a load of about 37 tons after only about a 1 cm reduction in length. A small load loss of a little more than two tons occurred at about 2 cm compression as the groove 22 collapsed as illustrated in FIG. 2 (*a*). The prop then again picked up the load at about 3 cm compression after which it again shed a small amount of load as the timber fibres in the zone 18 began progressively to separate in a direction transverse to the prop axis as illustrated in FIGS. 2 (*b*) to (*d*). As is seen in FIG. 2 the zone of fibre separation of the timber increases and spreads in the zone 18 under load until the void 20 is filled with tightly compressed timber fibres.

Ideally this should occur as the ends of the head and foot pieces of the prop are flush or almost so with the ends of the sleeve 12 as illustrated in FIG. 2 (*d*).

The FIG. 2 (*d*) degree of compression of the test prop was reached in Graph A of FIGS. 3 at about 20 cm or 17% reduction in overall length of the prop.

From the point at which the press came into contact with the ends of the sleeve 12 the prop acted as an almost rigid column support and its load supporting ability climbed as illustrated in Graph A. Between the 20 and 28 cm closure points on Graph A the metal of the sleeve bulged radially outwardly and wrinkled as it was reduced in length while being forced to accommodate the fibrous material of the crushed timber. The prop was fully load supporting at 28 cm (23% reduction in length) and failed at about 35 cm closure.

A conventional prop, which was similar to the prop of FIG. 1, was tested as a comparison to the FIG. 1 prop. The conventional prop consisted of a parallel sided saligna log which was 1,200 mm in length with a diameter of 152 mm and a 4 mm mild steel sleeve which was 1,000 mm in length. The log was in intimate contact with the sleeve over the entire sleeve length. The graph of this test is Graph B in FIG. 3.

As is seen from Graph B the conventional prop equally rapidly accepted load but almost equally rapidly shed about 15 tons load as the timber fibres in one of the projecting unrestrained timber ends began to separate. The second large load loss occurred at about 9 cm of closure when fibre separation commenced in the remaining protruding timber end and the prop then became in effect a rigid support. The graph load then climbed and finally decayed before failure of the sleeve as illustrated in the graph.

From the above description and FIG. 3 it is apparent that the principle advantages of the prop of the invention over the conventional prop as described above is that the prop of the invention is more uniformly load supporting without sharp load shedding cycles than the conventional prop and because it employs less steel in its sleeve than the conventional prop it is cheaper which is an important consideration in a country such as South Africa where many thousands of the conventional props are finding use.

The profile of the timber member 10 is not limited to that illustrated in FIG. 1 and the reduced diameter portion of the member may be suitably shaped or profiled to provide props having various load-compression characteristics.

The compression characteristics of the various props of the invention depend on parameters such as the lengths of; the projecting portions of the foot and head pieces 14 and 16, the lengths of the pieces 14 and 16 which are engaged with the sleeve and the length of the profiled zone 18 of the member 10 as well as the ratio of these to diameter.

The compression characteristics also depend on the radius or diametrical ratio, i.e. the ratio of total diameter of the member 10 to the diameter of the profiled zone 18; the volume of the void 20; the ratio of diameter to overall length; the ratio of sleeve length to prop length; the type of timber used and its moisture content as well as the frictional loading on the head and foot pieces of the timber member.

Figure 4:
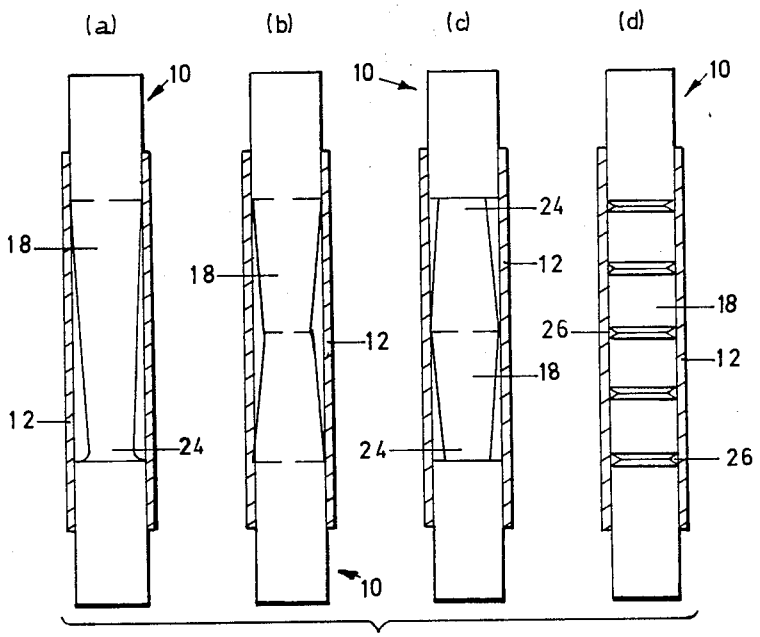
FIGS. 4(*a*) to (*d*) are views similar to that of FIG. 1 of a further four embodiments of the prop of the invention.

FIG. 4 illustrates four further embodiments of the prop of the invention. Each profiled portion of each timber member 10 may be cut to any radius ratio between 0:4 and 0:99. Radius ratios of 0:85 have been found preferable and radius ratios of 0:4 or less will probably not be acceptable because of poor total loading capability.

In all of the profiles shown in FIG. 4 stress (load per unit area) is set up in the profiled section once the force of static friction has been overcome in either one of the two friction zones, when the unit is subjected to axial loading. Naturally, the stress in the timber member 10 is highest where the diameter is smallest and this is the point at which fibre separation begins. In the FIG. 1 prop fibre separation may begin anywhere along its profiled length in the zone 18.

In the case of the props illustrated in FIGS. 4 (*a*), (*b*) and (*c*) the drop in initial load is much less rapid than that illustrated in graph B of FIG. 3 and may remain substantially constant if the radius ratio is small enough.

In all of the illustrated props of the invention the tendency is for load to decrease once fibre seperation commences but in the case of the FIG. 4 (*a*) prop the load tends to remain more constant. This is because as the fibre separation zone increases from the base 24 along the length of the zone 18 the cross-sectional area of the profiled portion of the member 10 increases thus reducing stress.

Since cross-sectional area is directly proportional to the square of the radius the change in area is fairly rapid with respect to change in compression. This tends to increase the loading rapidly and thus against the general tendency towards decreased loading the overall effect is to maintain a relatively constant load.

The FIG. 4 (*b*) prop operates in much the same manner as the FIG. 4 (*a*) prop. The FIG. 4 (*c*) prop because of the two reduced diameter portion 24 in the zone 18, tends to have two peaks after the first point of inflection on the load compression curve as fibre separation commences at each end of the zone 18.

Any of the props of FIG. 1 and FIG. 4 (*a*) to (*c*) could be provided with suitably spaced and dimensioned secondary grooves 22 in their profiled zones 18 to minimise undesirable load deflections at any point on their compression curves. The necessity, position and size of the grooves will, for a particular load/compression characteristic, have to be determined by experimentation.

The prop of FIG. **4*d* does not have an elongated reduced diameter groove or zone 18 but rather a plurality of small zones of reduced diameter defined by grooves 26. Although the grooves 26** are all shown in the drawing to be of equal dimension they may be more or less in number and have varying widths depths and locations to suit particular load supporting requirements.

The prop of the invention is not limited to the precise constructional details as herein described and the sleeve 12 could for example be made from glass fibre reinforced resin which is adapted progressively to burst from the ends of the sleeves towards the centre of the sleeve as load is applied to it.

Also, it is not essential to the invention that the timber load support member 10 consists of a single timber element and for example in the FIG. 1 embodiment of the prop one or all three of the portions 14, 16 and 18 could consist of separate suitably located timber elements and in the FIG. 4(*b*). and (*c*) embodiments the member 10 could be separated on a transverse central line.

I claim:

1. A mine support prop comprising a timber load support member which is elongated in the direction of its grain and yieldable in its lengthwise direction, and which includes a zone of reduced cross-sectional area that is no less than 40% of the cross-sectional area of the non-reduced portion of the timer member and a sleeve which surrounds and supports the timber member over and on either side of its zone of reduced cross-section, with the sleeve being out of contact with the timber member in its zone of reduced cross-sectional area to define a void between said sleeve and said zone, said sleeve being constructed of ductile mild steel adapted yieldably to restrain an increase in the cross-sectional dimension of the timber member as the prop is reduced in length under load.

2. A mine support prop comprising a timber load support member which is elongated in the direction of its grain and yieldable in its lengthwise direction, and which includes a zone of reduced cross-sectional area that is no less than 40% of the cross-sectional area of the non-reduced portion of the timber member and a sleeve which surrounds and supports the timber member over and on either side of its zone of reduced cross-section, the cross-sectional area of the reduced zone decreasing in cross-sectional area from one end of its length to the other in the sleeve, with the sleeve being out of contact with the timber member in its zone of reduced cross-sectional area to define a void between said sleeve and said zone, said sleeve extending over a substantial proportion of the length of the timber member and the zone of reduced cross-sectional area extending over a substantial proportion of the length of the timber member in the sleeve but wherein the length of the zone of said reduced cross-sectional area is less than the length of the sleeve.

3. A mine support prop comprising a timber load support member which is elongated in the direction of its grain and yieldable in its lengthwise direction, and which includes a zone of reduced cross-sectional area that is no less than 40% of the cross-sectional area of the non-reduced portion of the timber member and a sleeve which surrounds and supports the timber member over and on either side of its zone of reduced cross-section, the cross-sectional area of the reduced zone decreasing towards each end of its length from a substantially central point in its length, with the sleeve being out of contact with the timber member in its zone of reduced cross-sectional area to define a void between said sleeve and said zone, said sleeve extending over a substantial proportion of the length of the timber member and the zone of reduced cross-sectional area extending over a substantial proportion of the length of the timber member in the sleeve but,wherein the length of the zone of said reduced cross-sectional area is less than the length of the sleeve.

4. A mine support prop comprising a timber load support member which is elongated in the direction of its grain and yieldable in its lengthwise direction, and which includes a zone of reduced cross-sectional area that is not less than 40% fo the cross-sectional area of the non-reduced portion of the timber member, the zone of reduced cross-sectional area being formed by a circumferential groove in the support member, and a sleeve which surrounds and supports the timber member over and on either side of its zone of reduced cross-section, the support member having at least two of said grooves formed therein located within the sleeve, with the sleeve being out of contact with the timber member in its zone of reduced cross-sectional area to define a void between said sleeve and said zone.

* * * * *